US010894429B2

(12) United States Patent
Sun et al.

(10) Patent No.: US 10,894,429 B2
(45) Date of Patent: Jan. 19, 2021

(54) DETERMINATION OF PRINTER DRYER TARGET TEMPERATURES

(71) Applicant: Hewlett-Packard Development Company, L.P., Spring, TX (US)

(72) Inventors: Weiyun Sun, Vancouver, WA (US); Dawn M Beachnau Hood, Vancouver, WA (US); Robert Yraceburu, Vancouver, WA (US); Mark H Mackenzie, Vancouver, WA (US); Brooke Hoyer, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/332,058

(22) PCT Filed: Sep. 12, 2016

(86) PCT No.: PCT/US2016/051370
§ 371 (c)(1),
(2) Date: Mar. 11, 2019

(87) PCT Pub. No.: WO2018/048452
PCT Pub. Date: Mar. 15, 2018

(65) Prior Publication Data

US 2019/0202216 A1 Jul. 4, 2019

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002; B41J 2/01
See application file for complete search history.

(56) References Cited

U.S. PATENT DOCUMENTS

| | | | |
|---|---|---|---|
| 5,202,769 | A | 4/1993 | Suzuki |
| 7,004,554 | B2 | 2/2006 | Takekoshi et al. |
| 7,840,071 | B2 | 11/2010 | Tang et al. |
| 8,045,201 | B2 | 10/2011 | Yamazaki |
| 8,313,188 | B2 | 11/2012 | Muro et al. |
| 10,560,584 | B2 | 2/2020 | Beachnau Hood et al. |

(Continued)

FOREIGN PATENT DOCUMENTS

WO WO-2017099804 6/2017

OTHER PUBLICATIONS

Michelson, M.G., Computerized Process and Printer Control Part Ii: Printer Control, Aug. 1973, < http://ieeexplore.ieee.org/~1 page~Journal of the SMPTE v 82 #8.

*Primary Examiner* — Justin Seo
(74) *Attorney, Agent, or Firm* — HP Inc. Patent Department

(57) ABSTRACT

According to an example, an apparatus may include a fluid coverage engine to determine which pixels of an image are to receive print fluid. The apparatus may also include a pixel count engine to compute a count of pixels at which print fluid is to be applied onto a media from the determined pixels of the image that are to receive print fluid, a target temperature engine to determine a target temperature for a dryer based upon the computed count of pixels, and a dryer engine to cause the dryer to become heated to the determined target temperature.

19 Claims, 4 Drawing Sheets

(56) References Cited

U.S. PATENT DOCUMENTS

| | | | | |
|---|---|---|---|---|
| 2003/0234847 | A1* | 12/2003 | Takekoshi | B41J 2/335<br>347/102 |
| 2011/0043861 | A1 | 2/2011 | Xu et al. | |
| 2011/0279612 | A1 | 11/2011 | Muro et al. | |
| 2012/0287196 | A1 | 11/2012 | Boland et al. | |
| 2014/0092400 | A1 | 4/2014 | Bayona et al. | |

* cited by examiner

DETERMINATION OF PRINTER DRYER TARGET TEMPERATURES

CROSS REFERENCE TO RELATED APPLICATION

The present application contains similar information to PCT/US2015/065326 filed on Dec. 11, 2015, the disclosure of which is hereby incorporated by reference in its entirety.

BACKGROUND

In many printing systems, printing components, such as printheads are used to apply marking material (e.g., fluid or ink) onto a print media. The print media is typically driven past the printheads and through a dryer. The dryer heats the print media and dries the marking material onto the print media. The print media often moves quickly across the printing system in order to enable fast printing speeds. If the dryer is unable to adequately dry the marking material, the marking material may remain in liquid form and may thus be prone to smearing or other defects. However, if the dryer applies too much heat, over-drying may occur and the print media may become brittle or warped. In addition, application of too much heat wastes energy as the dryer consumes more energy than is required to properly dry the marking material onto the print media.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
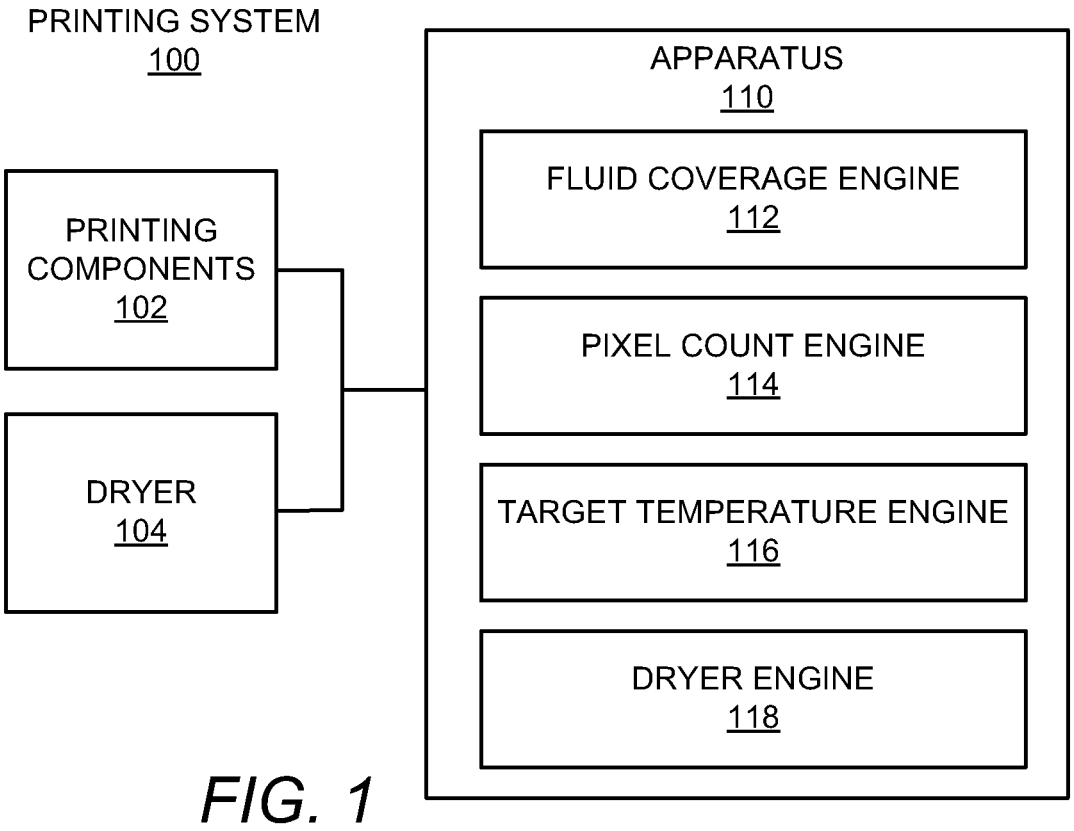
FIGS. 1-3, respectively, depict block diagrams of example printing systems.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Additionally, It should be understood that the elements depicted in the accompanying figures may include additional components and that some of the components described in those figures may be removed and/or modified without departing from scopes of the elements disclosed herein. It should also be understood that the elements depicted in the figures may not be drawn to scale and thus, the elements may have different sizes and/or configurations other than as shown in the figures.

Disclosed herein are apparatuses and methods for determining a target temperature for a printing system dryer. In the apparatuses and methods disclosed herein, a processor may determine the target temperature for the printing system (or printer) dryer based upon a computed count of pixels on a media at which print fluid is to be applied. For instance, the target temperature may be determined to be a higher temperature in response to the computed count of pixels being higher and a lower temperature in response to the computed count of pixels being lower. In other examples, the target temperature may be determined to be any of additional temperatures depending upon the computed count of pixels.

According to an example, the target temperature for the printing system dryer may be determined based upon print data of an image to be printed prior to the image being halftoned. That is, the pixels on the media that are to receive print fluid may be identified and the count of those pixels may be computed prior to the image undergoing a halftoning operation. As the halftoning operation of the image may consume a relatively long period of time, determination of the target temperature prior to undergoing the halftoning operation may enable the target temperature to be determined at an early stage in the processing of the image. In one regard, by determining the target temperature early in the image processing operation, the dryer may also begin to be heated and may reach the target temperature early in the image processing operation. As a result, a printed media may be outputted in a relatively quick manner.

Through implementation of the apparatuses and methods disclosed herein, printing system dryers may be operated to deliver high printing performance while reducing electricity consumption. For instance, printing system dryers may be set at levels below maximum temperature settings for printed media that do not require that level of heat. Instead, the printing system dryers may be set to temperature levels that correspond to the amount of heating required to sufficiently dry print fluid onto the media without causing deleterious effects from under or over-drying of the print fluid and the media. In addition, as the printing system dryers typically require a relatively long period of time to reach the target temperatures, implementation of the apparatuses and methods disclosed herein may enable the printing system dryers to begin to warm up sooner in the printing operation such that the printing system dryers may be at the target temperatures when print media is delivered to the printing system dryers. In another regard, therefore, the printing system may not need to wait for the printing system dryers to reach target temperatures before beginning to print onto a media.

Figure 2:
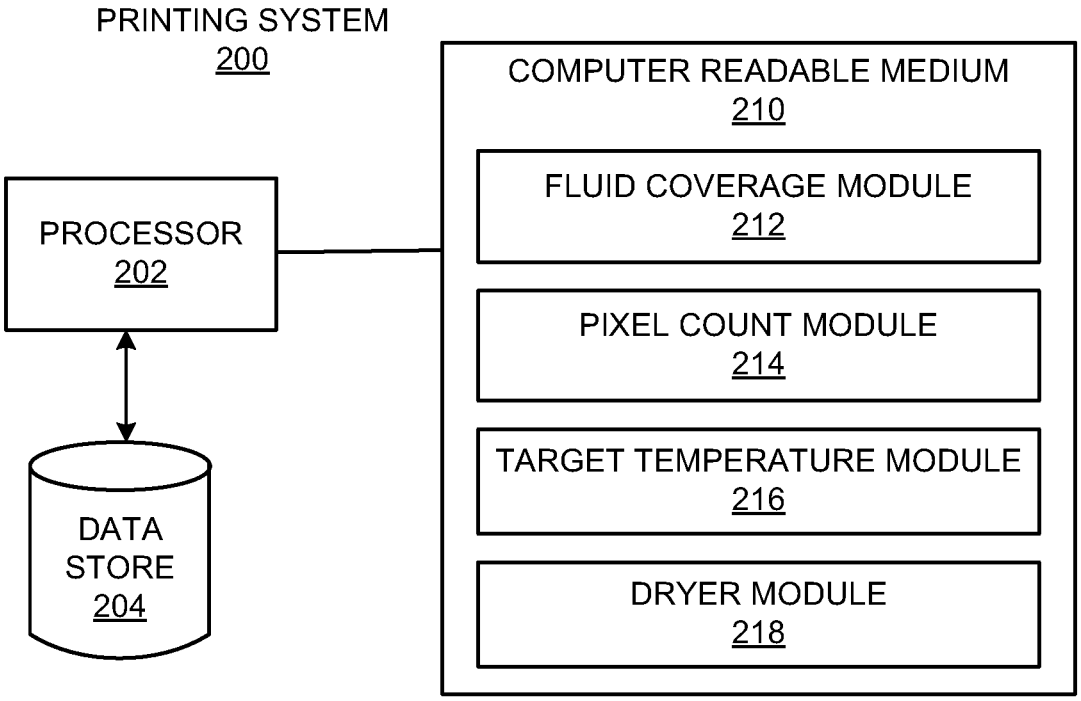

FIGS. 1 and 2 are block diagrams depicting example printing systems 100 and 200. It should be understood that the printing systems 100 and 200 depicted in FIGS. 1 and 2 may include additional components and that some of the components described herein may be removed and/or modified without departing from a scope of the printing systems 100 and 200 disclosed herein.

Referring to FIG. 1, the example printing system 100 may include printing components 102, a dryer 104, and an apparatus 110. The dryer 104 may equivalently be termed a fuser, a heating element, or the like, and may be a component of the printing system 100 that dries print fluid onto the media. In general, the apparatus 110 may estimate a target temperature for the dryer 104 and may control the dryer 104 to reach the target temperature in order to allow media to be printed in a relatively fast manner. More particularly, for instance, the apparatus 110 may estimate the target temperature and begin to heat up the dryer 104 prior to an image to be printed onto a media undergoing a halftoning operation. In other words, the apparatus 110 may estimate the target temperature for the dryer 104 without using halftoning information of the image and may begin heating the dryer 104 based upon the estimated target temperature. In one regard, the dryer 104 may thus begin to start being heated relatively early during a printing process, which may allow the printing system 100 to output printed media in less time if such heating were started further along the printing process.

The printing components 102 may represent any mechanical part of the printing system 100, electrical part of the printing system 100, or combination thereof. The printing system 100 may be an inkjet printing system, a laser printing system, or a 3D printing system, or the like. An example inkjet printing system may include components such as a fluid ejection assembly (e.g., a printhead assembly), a fluid supply assembly, a carriage assembly, a print media transport assembly, a service station assembly, and an electronic controller to facilitate control of the any number of components. The printing components 102 may also include a print bar, a paper guide, a separator pad, a pinch roller, an alignment roller, a starwheel, a drum, a clamp, a servo, a pick tire, a fan, a tray, a bail, a power control unit, alignment devices, a stapler device, a hole punch device, a saddle stitching device, and the like. Example laser (e.g. toner) printing systems and/or example 3D printing systems may contain similar components, related components, or different components that may be adjustable (e.g., able to change to different operational states, such as two or more operational states).

The apparatus 110 may be a processing component of the printing system 100, such as a circuit board, motherboard, or the like, of the printing system 100. The apparatus 110 may include a fluid coverage engine 112, a pixel count engine 114, a target temperature engine 116, and a dryer engine 118. The fluid coverage engine 114 may represent any circuitry or combination of circuitry and executable instructions to identify coverage of print fluid to be applied onto a media. For instance, the fluid coverage engine 114 may access print data for the media, in which the print data may include information pertaining to an image that is to be printed onto the media. The fluid coverage engine 114 may determine which locations of the image are to receive print fluid based upon the accessed print data. The print data may be mapped to topographical regions of the media to receive print fluid and the media may be divided into a plurality of pixels (or voxels) or groups of pixels (super pixels).

Examples of the media may include any type of suitable sheet material, such as paper, card stock, transparencies, fabric, packaging material, and the like. Examples of print fluid may include ink, toner, or other type of marking material having one or multiple colors. The print data may include information pertaining to a rasterized version of the image and may identify locations, e.g., pixels, at which print fluid having different colors is to be applied as well as the densities at which the print fluid(s) are to be deposited.

The pixel count engine 114 may represent any circuitry or combination of circuitry and executable instructions to compute a count of pixels at which print fluid is to be applied onto a media. The pixel count engine 114 may compute a count of pixels based upon the pixels of the image that are to receive print fluid determined by the fluid coverage engine 112. For instance, the pixel count engine 114 may assign a value of "1" to each pixel that is to receive print fluid and may assign a value of "0" to each pixel that is not to receive print fluid. In other examples, the pixel count engine 114 may assign different values to the pixels depending upon whether the pixels are to receive print fluid. The pixel count engine 114 may also add up the total number of pixels that are to receive the print fluid to compute the count of pixels.

The target temperature engine 116 may represent any circuitry or combination of circuitry and executable instructions to determine a target temperature for the dryer 104. The target temperature engine 116 may determine the target temperature for the dryer 104 based upon the count of pixels that are to receive print fluid as determined by the pixel count engine 114. In some examples, the target temperature engine 116 may determine the target temperature for the dryer 104 solely based upon the computed count of the pixels that are to receive print fluid. In some examples, the target temperature engine 116 may determine the target temperature based upon a comparison of the computed count of pixels that are to receive print fluid and a predetermined threshold count.

For instance, in response to the computed count of pixels that are to receive print fluid falling below the predetermined threshold count, the target temperature engine 116 may determine the target temperature to be a predefined low target temperature. Likewise, in response to the computed count of pixels that is to receive print fluid exceeding the predetermined threshold count, the target temperature engine 116 may determine the target temperature to be a predefined high target temperature. In other examples, the target temperature engine 116 may compare the computed count of pixels to multiple predetermined threshold counts and may determine the target temperature to be one of more than two possible predefined target temperatures. The predetermined threshold count(s), the predefined target temperatures, and correlations between the predetermined threshold count(s) and the predefined target temperatures may be determined through testing and may be programmed in the target temperature engine 116 and/or stored in a data store of the printing system 100.

The dryer engine 118 may represent any circuitry or combination of circuitry and executable instructions to cause the dryer 104 to become heated to the target temperature determined by the target temperature engine 116. The dryer engine 118 may instruct or otherwise control the dryer 104 to become activated to reach the target temperature. For instance, the dryer engine 118 may communicate instructions to a controller (not shown) of the dryer 104 to activate the dryer 104 such that the dryer 104 begins to heat up to the target temperature. According to an example, the apparatus 110 may estimate the target temperature for the dryer 104 and may cause the dryer 104 to be heated to the target temperature prior to a media being positioned to be heated by the dryer 104, which may reduce the amount of time required to output a printed media while also reducing energy consumption as compared with maintaining the dryer 104 at or above the target temperature for periods of time greater than are necessary to dry the print fluid and the media.

Although not shown, the printing system 100 may include an engine to halftone the image pertaining to the print data. In addition, the printing system 100 may include an engine to determine a second target temperature from the halftone information. For instance, the second target temperature may be determined based upon the densities and/or locations at which print fluid is to be applied to the media. The second target temperature may be determined in any of the manners discussed in PCT/US2015/065326. As the second target temperature may be determined based upon more specific information pertaining to the image to be printed, e.g., density information at which the print fluid is to be applied, the second target temperature may reflect more accurately the temperature at which the dryer 104 should be set to dry the print fluid onto the media. According to an example, the dryer engine 118 may cause the dryer 104 to become heated to the second target temperature from the target temperature. In the event that second target temperature is equal to the target temperature, the dryer engine 118 may not change the dryer temperature.

As shown in FIG. 2, the example printing system 200 may include a processor 202 and a computer readable medium 210, in which the computer readable medium 210 is operatively coupled to the processor 202. The computer readable medium 210 may contain a set of instructions that are executable by the processor 202. The printing system 200 may also include a data store 204 on which the processor 202 may store various information, such as print data, thresholds, etc. The set of instructions may cause the processor 202 to perform operations of the printing system 200 when the processor 202 executes the set of instructions. The set of instructions stored on the computer readable medium 210 may be represented as a fluid coverage module 212, a pixel count module 214, a target temperature module 216, and a dryer module 218. The fluid coverage module 212, the pixel count module 214, the target temperature module 216, and the dryer module 218 may represent machine readable instructions that when executed function as the fluid coverage engine 112, the pixel count engine 114, the target temperature module 116, and the dryer engine 118 of the apparatus 110 depicted in FIG. 1, respectively.

The processor 202 may carry out a set of instructions to execute the modules 212-218, and/or any other appropriate operations among and/or associated with the modules of the printing system 200. For example, the processor 202 may carry out a set of instructions to determine which pixels of an image are to receive print fluid, compute a count of pixels at which print fluid is to be applied, determine a target temperature for a dryer, and cause the dryer to become heated to the determined target temperature.

Although modules 212-218 are illustrated and discussed in relation to FIG. 2 and other example implementations, other combinations or sub-combinations of modules may be included within other implementations. Stated differently, although the modules illustrated in FIG. 2 and discussed in other example implementations may perform specific functionalities in the examples discussed herein, these and other functionalities may be accomplished, implemented, or realized at different modules or at combinations of modules. For example, two or more modules illustrated and/or discussed as separate may be combined into a module that performs the functionalities discussed in relation to the two modules. As another example, functionalities performed at one module as discussed in relation to these examples may be performed at a different module or different modules.

The processor 202 may be any appropriate circuitry that is to process (e.g., computing) instructions, such as one or multiple processing elements that may retrieve instructions from the computer readable medium 210 and executing those instructions. For example, the processor 202 may be a central processing unit (CPU) that enables operational adjustment by fetching, decoding, and executing the modules 212-218. Example processors 202 may include at least one CPU, a semiconductor-based microprocessor, a programmable logic device (PLD), and the like. Example PLDs may include an application specific integrated circuit (ASIC), a field-programmable gate array (FPGA), a programmable array logic (PAL), a complex programmable logic device (CPLD), and an erasable programmable logic device (EPLD). The processor 202 may include multiple processing elements that are integrated in a single device or distributed across devices. The processor 202 may process the instructions serially, concurrently, or in partial concurrence.

The computer readable medium 210 may represent a medium to store data utilized and/or produced by the printing system 200. The computer readable medium 210 may be any non-transitory medium or combination of non-transitory mediums able to electronically store data, such as the modules 212-218 and/or data used by the printing system 200. For example, the computer readable medium may be distinct from a transitory transmission medium, such as a signal. As used herein, a non-transitory computer readable medium may refer to any storage medium with the exclusion of a signal. The computer readable medium may be an electronic, magnetic, optical, or other physical storage device that may contain (i.e., store) executable instructions. The computer readable medium 210 may store program instructions that when executed by the processor 202 cause the processor 202 to implement functionality of the printing system 200. The computer readable medium 210 may be integrated in the same device as the processor 202 or may be separate but accessible to that device and the processor 202. The computer readable medium 210 may also be distributed across devices.

In the discussions above, the engines 112-118 shown in FIG. 1 and the modules 212-218 shown in FIG. 2 have been described as circuitry or a combination of circuitry and executable instructions. Such components may be implemented in a number of fashions. With reference to FIG. 2, the executable instructions may be processor-executable instructions, such as program instructions, stored on the computer readable medium 210, which is a tangible, non-transitory computer-readable storage medium, and the circuitry may be electronic circuitry, such as processor 202, for executing those instructions. The instructions residing on the computer readable medium 210 may include any set of instructions to be executed directly (such as machine code) or indirectly (such as a script) by the processor 202.

In some examples, the printing system 200 may include the executable instructions or may be part of an installation package that when installed may be executed by the processor 202 to perform operations of the printing system 200, such as the methods described with regard to FIGS. 4-5 below. In that example, the computer readable medium 210 may be a portable medium such as a compact disc, a digital video disc, a flash drive, or memory maintained by a computer device, such as a server, from which the installation package may be downloaded and installed. In another example, the executable instructions may be part of an application or applications already installed. The computer readable medium 210 may be a non-volatile memory resource such as read only memory (ROM), a volatile memory resource such as random access memory (RAM), a storage device, or a combination thereof. Example forms of a computer readable medium 210 may include static RAM (SRAM), dynamic RAM (DRAM), electrically erasable programmable ROM (EEPROM), flash memory, or the like. The computer readable medium 210 may include integrated memory such as a hard drive (HD), a solid state drive (SSD), or an optical drive.

Figure 3:
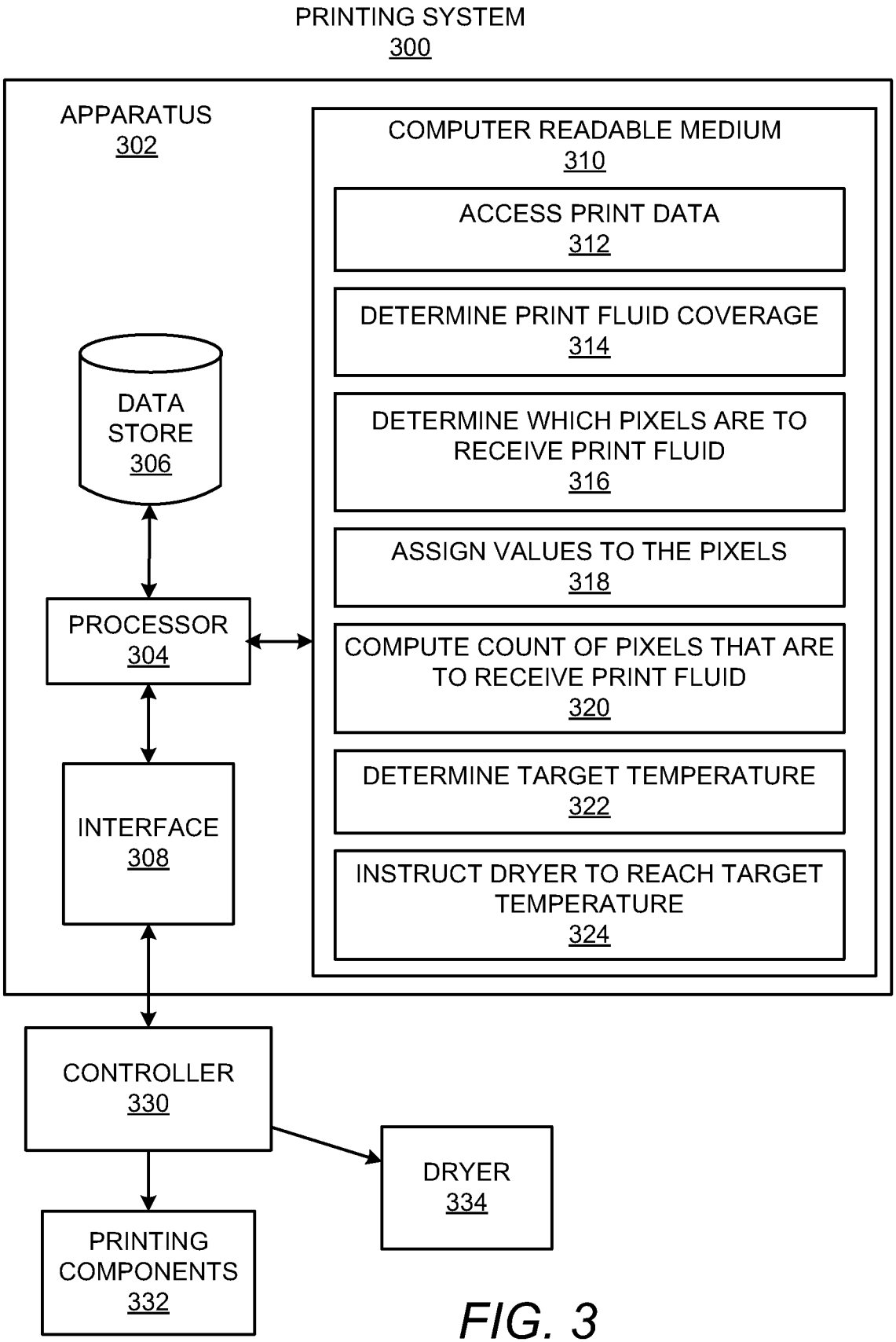

With reference now to FIG. 3, there is shown a simplified block diagram of another example printing system 300. It should be understood that the printing system 300 depicted in FIG. 3 may include additional components and that some of the components described herein may be removed and/or modified without departing from a scope of the printing system 300 disclosed herein.

The printing system 300 may include an apparatus 302, a controller 330, printing components 332, and a dryer 334. The apparatus 302 may be a computing device such as a personal computer, a server computer, a laptop computer, a tablet computer, a smartphone, or the like. In another example, the apparatus 302 may be a processing component of a printing device, such as a multi-function printer, a locally connected printer, a networked printer, or the like. The apparatus 302 may include a processor 304, a data store 306, an interface 308, and a computer readable medium 310. The processor 304, which may be a microprocessor, a micro-controller, an application specific integrated circuit (ASIC), or the like, may perform various processing functions in the apparatus 302. The processing functions may include invoking or implementing the instructions 312-324 stored in the computer readable medium 310. According to an example, the computer readable medium 310 may be a hardware device on which is stored the instructions 312-324. The computer readable medium 310 may be, for instance, a volatile or non-volatile memory, such as dynamic random access memory (DRAM), electrically erasable programmable read-only memory (EEPROM), magnetoresistive random access memory (MRAM), memristor, flash memory, floppy disk, a compact disc read only memory (CD-ROM), a digital video disc read only memory (DVD-ROM), or other optical or magnetic media, and the like, on which software may be stored.

The processor 304 may store data in the data store 306 and may use the data in implementing the instructions 312-324. For instance, the processor 304 may store data (e.g., print data) pertaining to images to be printed onto media, various threshold values that identify target temperatures for the dryer 334, correlations between various threshold values and target temperatures for the dryer 334, etc. In any regard, the data store 306 may be volatile and/or non-volatile memory, such as DRAM, EEPROM, MRAM, phase change RAM (PCRAM), memristor, flash memory, and the like. In addition, or alternatively, the data store 306 may be a device that may read from and write to a removable media, such as, a floppy disk, a CD-ROM, a DVD-ROM, or other optical or magnetic media.

The interface 308 may include hardware and/or software to enable the processor 304 to communicate with the controller 330. The interface 308 may also enable the processor 304 to access a network, such as an internal network, the Internet, etc., over which the processor 304 may receive print jobs, e.g., files containing data to be printed. The interface 308 may include a network interface card and/or may also include hardware and/or software to enable the processor 304 to communicate with various input and/or output devices, such as a keyboard, a mouse, a display, another computing device, etc., through which a user may input instructions into the apparatus 302.

The processor 304 may fetch, decode, and execute the instructions 312 to access print data, the instructions 314 to determine print fluid coverage of an image to be printed, the instructions 316 to determine which pixels corresponding to the image are to receive print fluid, the instructions 318 to assign values to the pixels, the instructions 320 to compute a count of pixels that are to receive print fluid, the instructions 322 to determine a target temperature for the dryer 334, and the instructions 324 to instruct the dryer 334 to reach the target temperature. As another example or in addition to retrieving and executing instructions, the processor 304 may include one or more electronic circuits that include hardware components and instructions for performing the functionalities of the instructions 312-324.

The apparatus 302 may be equivalent to the apparatus 110 depicted in FIG. 1 and the printing system 200 depicted in FIG. 2. Likewise, the processor 304 may be equivalent to the processor 202 depicted in FIG. 2. Additionally, the controller 330, the printing components 332, and the dryer 334 may form part of the apparatus 302. In these examples, the processor 304 and the controller 330 may be the same component.

Figure 4:
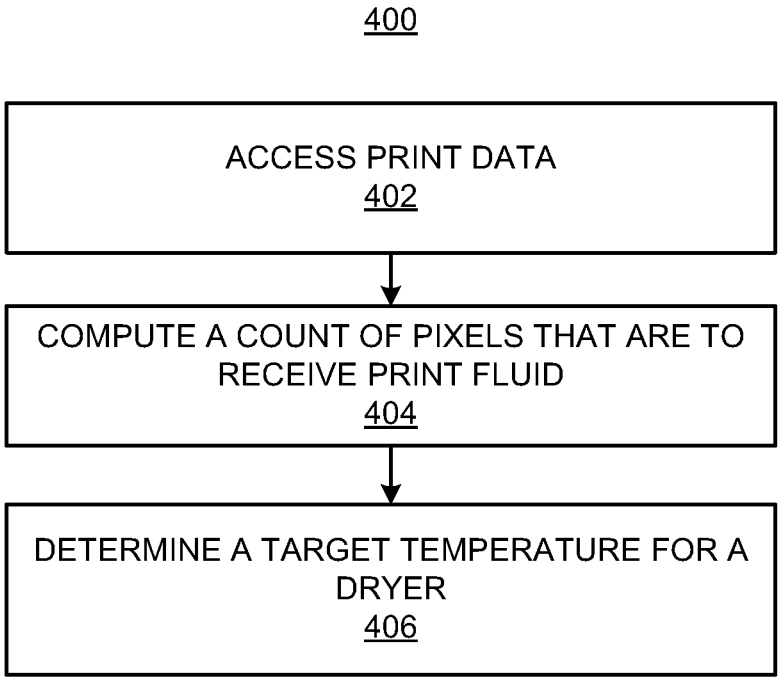
FIGS. 4 and 5, respectively, show flow diagrams of example methods for determining a target temperature for a printing system dryer.
Figure 5:
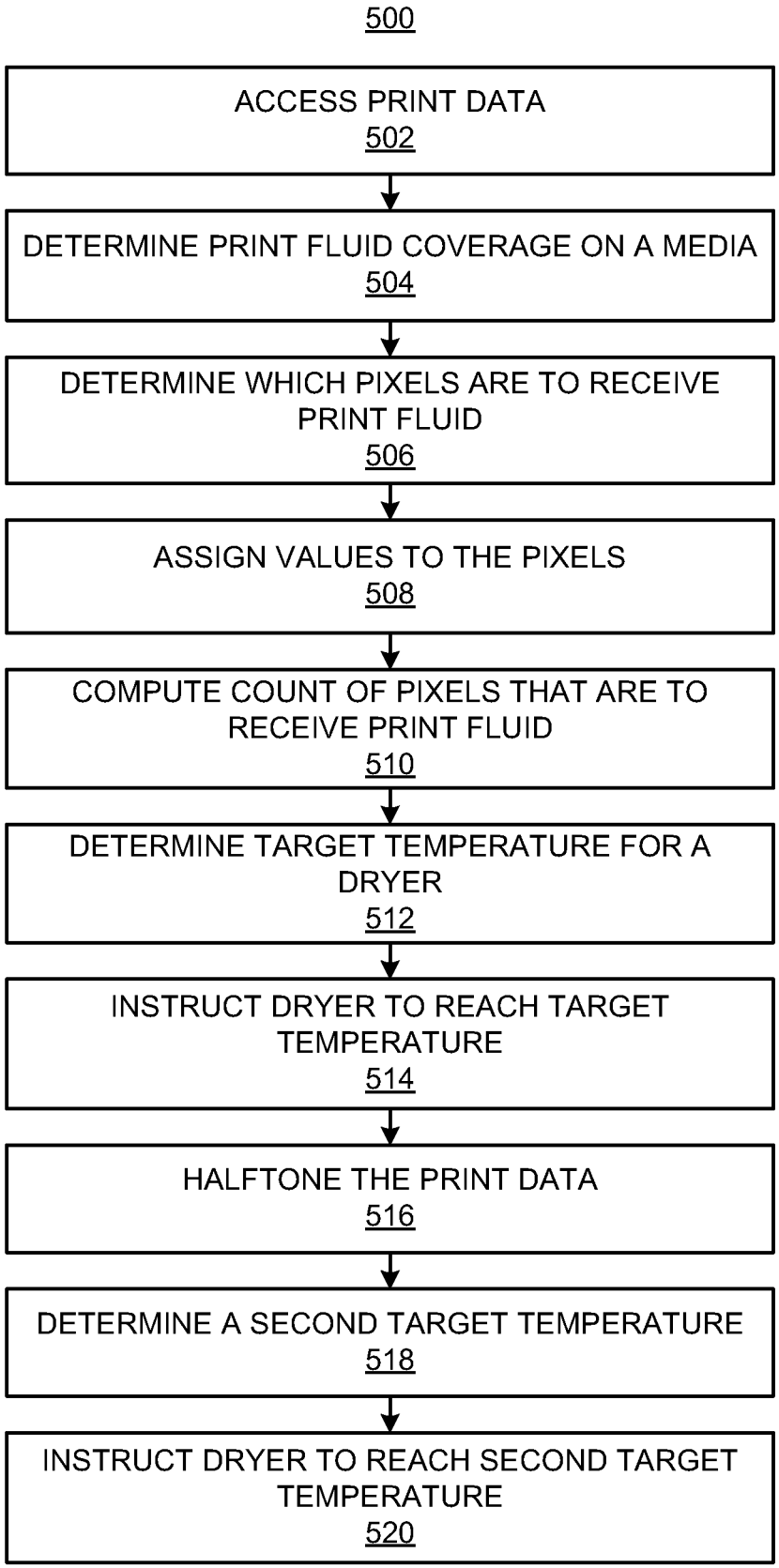

Various manners in which the processors 202, 304 in general, and the engines 112-118, the modules 212-218, and the instructions 312-324 in particular, may be implemented are discussed in greater detail with respect to the methods 400 and 500 respectively depicted in FIGS. 4 and 5. Particularly, FIGS. 4 and 5, respectively, depict flow diagrams of example methods 400 and 500 for determining a target temperature for a printing system dryer 104, 334. It should be apparent to those of ordinary skill in the art that the methods 400 and 500 may represent generalized illustrations and that other operations may be added or existing operations may be removed, modified, or rearranged without departing from the scopes of the methods 400 and 500. Generally speaking, either of the processors 202, 304 depicted in FIGS. 2 and 3 or the engines 112-118 may implement either or both of the methods 400 and 500.

The descriptions of the methods 400 and 500 are made with reference to the printing systems 100-300 illustrated in FIGS. 1-3 for purposes of illustration. It should, however, be clearly understood that printing systems having other configurations may be implemented to perform either or both of the methods 400 and 500 without departing from the scopes of the methods 400 and 500.

With reference first to the method 400 depicted in FIG. 4, at block 402, print data that identifies pixels on a media where print fluid is to be deposited may be accessed. For instance, the fluid coverage engine 112 shown in FIG. 1 may access the print data. As another example, the processor 202 may execute the fluid coverage module 212 to access the print data from the data store 204. As a further example, the processor 304 may execute the instructions 312 to access print data from the data store 306.

At block 404, a count of the pixels on the media that are to receive print fluid may be computed. The pixels on the media that are to receive print fluid may be identified from the access print data and the number of those pixels may be added together to compute the count of the pixels. As an example, the pixel count engine 114 shown in FIG. 1 may compute the count of the pixels on the media that are to receive print fluid. As another example, the processor 202 may execute the pixel count module 214 to compute the count of the pixels. As a further example, the processor 304 may execute the instructions 320 to compute the count of the pixels.

At block 406, a target temperature for a dryer 104, 334 may be determined based upon the computed count of the pixels that are to receive print fluid. For instance, the target temperature engine 116 shown in FIG. 1 may determine the target temperature for the dryer 104. As another example, the processor 202 may execute the target temperature module 216 to determine the target temperature for a dryer. As a further example, the processor 304 may execute the instructions 322 to determine the target temperature for the dryer 334.

Turning now to FIG. 5, at block 502, print data that identifies an image to be printed on a media may be accessed. The print data may be accessed in any of the manners discussed above with respect to block 402 in FIG. 4.

At block 504, print fluid coverage on the media may be determined. For instance, the print fluid coverage may be based upon where print fluid is to be deposited on the media to reproduce the image identified in the print data. The processor 304 may execute the instructions 314 to determine the print fluid coverage.

At block 506, a determination may be made as to which pixels on the media are to receive print fluid based upon the determined print fluid coverage. For instance, the image or the media may be mapped to a plurality of pixels and a determination may be made as to which of the pixels either contain data or are to receive print fluid. In an example, the processor 304 may execute the instructions 316 to determine which of the pixels are to receive print fluid.

At block 508, values may be assigned to the pixels. For instance, the processor 304 may execute the instructions 318 to assign values to the pixels depending upon whether the pixels contain data (e.g., are to receive print fluid) or do not contain data (e.g., are not to receive print fluid). By way of example, the processor 304 may assign a value of "1" to the pixels that contain data and may assign a value of "0" to the pixels that do not contain data.

At block 510, a count of pixels that are to receive print fluid may be computed. For instance, the processor 304 may execute the instructions 320 to compute the count of the pixels by adding up the assigned values of the pixels.

At block 512, a target temperature for the dryer 334 may be determined from the computed count of the pixels. For instance, the processor 304 may execute the instructions 322 to determine the target temperature for the dryer 334 based upon whether the computed count of the pixels exceeds a predetermined threshold count. In this example, the processor 304 may determine whether the computed count exceeds a predetermined threshold count. The predetermined threshold count may be determined through testing of various threshold counts and target temperatures and may be set based upon results of the testing. In other examples, the predetermined threshold count may be user-defined.

According to an example, the processor 304 may determine the target temperature to be a predefined high target temperature in response to a determination that the computed count exceeds the predetermined threshold count. In addition, a processor 304 may determine a target temperature to be a predefined low target temperature in response to a determination that the computed count falls below the predetermined threshold count. In other examples, the processor 304 may compare the computed count with a second predetermined threshold count. In these examples, the processor 304 may determine the target temperature to be one of the predefined high target temperature, the predefined low target temperature, and a further predefined target temperature depending upon whether the computed count falls below or exceeds the predetermined threshold count and/or the second predetermined threshold count. The dryer 334 may include any number of settings, e.g., from 2 to 10 settings, or the like, which may correspond to different predetermined threshold counts.

At block 514, the dryer 334 may be instructed to reach the determined target temperature. The processor 304 may execute the instructions 324 to instruct the dryer 334 to reach the determined target temperature. For instance, the processor 304 may communicate an instruction to the controller 330 to activate the dryer 334 and to cause the dryer 334 to become heated to the determined target temperature. As another example, the processor 304 may directly control the dryer 334 to be activated and become heated to the determined target temperature.

At block 516, the print data may be halftoned. For instance, the print data may undergo various processes, including halftoning, to enable the printing components 102 to print the image described in the print data. In various examples, the apparatus 110 depicted in FIG. 1 may include an additional engine or multiple engines that are to perform the various processes on the print data, which may include selection of a color map, selection of a depletion level, determining a color map and halftone of the image to identify print fluid color information, and determining densities at which the print fluid is to be applied onto the media to reproduce the image. In other examples, the computer readable medium 210 depicted in FIG. 2 may include an additional module or modules to perform the various processes on the print data. In further examples, the computer readable medium 310 depicted in FIG. 3 may include an additional instruction or sets of instructions to perform the various processes on the print data. In yet further examples, we various processes may be performed on the print data by an engine, a module, and/or a set of instructions that are contained in any of the apparatus 110, the computer readable medium 210, and the computer readable medium 310.

At block 518, a second target temperature for the dryer 334 may be determined from the halftoned print data. The second target temperature may be determined from the halftoned print data in any of the manners discussed in PCT/US2015/065326. In addition, a dryer fan (not shown) setting may also be determined in any of the manners discussed in PCT/US2015/065326. According to an example, the processor 304 may execute the instructions 322 to determine the second target temperature.

At block 520, the dryer 334 may be instructed to reach the determined second target temperature. The dryer 334 may be instructed to reach the determined second target temperature in any of the manners discussed above with respect to block 514. In examples in which the second target temperature is equivalent to the target temperature, the dryer 334 temperature may not be changed. However, in examples in which the second target temperature differs from the target temperature, the dryer 334 temperature may be modified to the second target temperature. In addition, the dryer fan may be set to the determined setting. In one regard the second target temperature may be a more accurate temperature for drying the print fluid and the media as compared with the target temperature because the second target temperature is determined using more precise data pertaining to the image to be printed.

Some or all of the operations set forth in the methods 400 and 500 may be contained as utilities, programs, or subprograms, in any desired computer accessible medium. In addition, the methods 400 and 500 may be embodied by computer programs, which may exist in a variety of forms both active and inactive. For example, they may exist as machine readable instructions, including source code, object code, executable code or other formats. Any of the above may be embodied on a non-transitory computer readable medium. Examples of non-transitory computer readable media include computer system RAM, ROM, EPROM, EEPROM, and magnetic or optical disks or tapes. It is therefore to be understood that any electronic device capable of executing the above-described functions may perform those functions enumerated above.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. An apparatus comprising:

a processor; and a non-transitory storage medium storing instructions executable on the processor to:

determine which pixels of an image are to receive print fluid;

assign a first value to each pixel of a first subset of pixels that are to receive the print fluid;

assign a second value to each pixel of a second subset of to pixels that are not to receive the print fluid;

compute, based on adding the first and second values assigned to the first subset of pixels and the second subset of pixels, respectively, a count of pixels at which the print fluid is to be applied onto a media;

determine whether the computed count exceeds a predetermined threshold count;

in response to a determination that the computed count exceeds the predetermined threshold count, determine a target temperature to be a first target temperature for a dryer; and cause the dryer to become heated to the determined target temperature.

2. The apparatus according to claim 1, wherein the instructions are executable on the processor to:

determine the target temperature for the dryer prior to print data pertaining to the image being halftoned; and cause the dryer to become heated to a second target temperature that is determined based upon halftone information of the print data pertaining to the image.

3. The apparatus according to claim 1, wherein the instructions are executable on the processor to determine the target temperature for the dryer solely based upon the computed count.

4. The apparatus according to claim 1, wherein the instructions are executable on the processor further to:

in response to a determination that the computed count falls below the predetermined threshold count, determine the target temperature to be a second target temperature that is lower than the first target temperature.

5. The apparatus according to claim 1, wherein the predetermined threshold count is a first predetermined threshold count, and wherein the instructions are executable on the processor further to:

in response to a determination that the computed count exceeds the first predetermined threshold count, determine whether the computed count exceeds a second predetermined threshold count; and determine the target temperature to be the first target temperature based upon the computed count exceeding both the first predetermined threshold count and the second predetermined threshold count.

6. A method comprising:

accessing, by a processor, print data that identifies pixels on a media where print fluid is to be deposited;

assigning, by the processor, a first value to each pixel of a first subset of pixels that are to receive the print fluid;

assigning, by the processor, a second value to each pixel of a second subset of pixels that are not to receive the print fluid;

computing, by the processor based on adding the first and second values assigned to the first subset of pixels and the second subset of pixels, respectively, a count of the pixels that are to receive the print fluid;

determining, by the processor, whether the computed count exceeds a predetermined threshold count; and in response to a determination that the computed count exceeds the predetermined threshold count, determining, by the processor, a target temperature to be a first target temperature for a dryer.

7. The method according to claim 6, further comprising:

activating the dryer to reach the target temperature, and wherein the determining the target temperature for the dryer comprises determining the target temperature for the dryer solely based upon the computed count.

8. The method according to claim 6, further comprising:

selecting a colormap of the print data; and halftoning the print data, wherein determining the target temperature comprises determining the target temperature prior to the selecting of the colormap and the halftoning of the print data.

9. The method according to claim 8, further comprising:

determining a second target temperature for the dryer based upon the halftoning; and manipulating the dryer to achieve the second target temperature.

10. The method according to claim 6, further comprising:

in response to a determination that the computed count falls below the predetermined threshold count, determining the target temperature to be a second target temperature that is lower than the first target temperature.

11. The method according to claim 6, wherein the predetermined threshold count is a first predetermined threshold count, and the method further comprising:

in response to a determination that the computed count exceeds the first predetermined threshold count, determining whether the computed count exceeds a second predetermined threshold count; and determining the target temperature to be the first target temperature based upon the computed count exceeding both the first predetermined threshold count and the second predetermined threshold count.

12. A non-transitory computer readable medium comprising instructions that when executed cause a system to:

access print data that identifies pixels on a media where print fluid is to be deposited;

assign a first value to each pixel of a first subset of pixels that are to receive the print fluid;

assign a second value to each pixel of a second subset of pixels that are not to receive the print fluid;

compute, based on adding the first and second values assigned to the first subset of pixels and the second subset of pixels, respectively, a count of the pixels that are to receive the print fluid;

determine whether the computed count exceeds a predetermined threshold count;

set a target temperature as a predefined lower target temperature for a dryer in response to the computed count falling below the predetermined threshold count;

set the target temperature to a predefined higher target temperature for the dryer in response to the computed count exceeding the predetermined threshold count number; and instruct the dryer to become heated to the target temperature.

13. The non-transitory computer readable medium according to claim 12, wherein the instructions when executed cause the system to:

set the target temperature prior to halftoning of the print data; and determine a second target temperature for the dryer based upon the halftoning of the print data; and instruct the dryer to become heated to the second target temperature.

14. The apparatus according to claim 1, wherein the first value assigned to each pixel of the first subset of pixels is 1, and the second value assigned to each pixel of the second subset of pixels is 0.

15. The apparatus according to claim 14, wherein the instructions are executable on the processor to compute the count by summing each instance of 1 assigned to the pixels of the first subset of pixels, and summing each instance of 0 assigned to the pixels of the second subset of pixels.

16. The method according to claim 6, wherein the first value assigned to each pixel of the first subset of pixels is 1, and the second value assigned to each pixel of the second subset of pixels is 0.

17. The method according to claim 16, wherein the computing of the count comprises summing each instance of 1 assigned to the pixels of the first subset of pixels, and summing each instance of 0 assigned to the pixels of the second subset of pixels.

18. The non-transitory computer readable medium according to claim 12, wherein the first value assigned to each pixel of the first subset of pixels is 1, and the second value assigned to each pixel of the second subset of pixels is 0.

19. The non-transitory computer readable medium according to claim 18, wherein the instructions upon execution cause the system to compute the count by summing each instance of 1 assigned to the pixels of the first subset of pixels, and summing each instance of 0 assigned to the pixels of the second subset of pixels.

* * * * *